US005297312A

United States Patent [19]

Zuiderveen et al.

[11] Patent Number: 5,297,312

[45] Date of Patent: Mar. 29, 1994

[54] CLEANING APPLIANCE WITH AGITATION MEMBER MOUNTING BRACKET

[75] Inventors: Marc D. Zuiderveen, Hudsonville; Charles A. Reed, Jr., Rockford; Scott R. Graham, Grand Rapids, all of Mich.

[73] Assignee: Bissell Inc., Grand Rapids, Mich.

[21] Appl. No.: 50,708

[22] Filed: Apr. 21, 1993

[51] Int. Cl.[5] ..... A47L 5/30

[52] U.S. Cl. ..... 15/391; 15/392

[58] Field of Search ..... 15/377, 392, 389, 391

[56] References Cited

U.S. PATENT DOCUMENTS

| | | | |
|---|---|---|---|
| 1,591,325 | 7/1926 | Kirby | 15/391 X |
| 1,783,205 | 12/1930 | White | 15/392 |
| 2,253,997 | 8/1941 | Becker . | |
| 2,601,698 | 7/1952 | Humphrey . | |
| 2,627,623 | 2/1953 | Humphrey . | |
| 2,780,819 | 2/1957 | Gall . | |
| 3,053,490 | 9/1962 | Weeks . | |
| 3,204,281 | 9/1965 | Lamken et al. | 15/377 X |
| 4,167,801 | 9/1979 | Erbor et al. . | |
| 4,375,117 | 3/1983 | Lyman | 15/389 X |

*Primary Examiner*—Chris K. Moore

*Attorney, Agent, or Firm*—Varnum, Riddering, Schmidt & Howlett

[57] ABSTRACT

A floor cleaning appliance having a pivotally mounted bracket for selectively tensioning an agitation motor drive belt is disclosed. The appliance includes a housing and a bracket pivotally mounted to the housing about a first axis of rotation. The bracket is supported in an operating position and a belt replacement position. An agitation member is selectively mounted to the bracket for rotation about a second axis of rotation. A drive motor is mounted in the housing having a drive shaft which rotates about a third axis of rotation. The drive belt is selectively mounted to the agitation member and the drive shaft when the bracket is mounted in the operating position. In this position the first axis of rotation lies on one side of a plane extending between the second and third axes of rotation whereas in the belt replacement position the first axis of rotation lies on the other side of the plane extending between the second and third axes of rotation. Therefore, the belt is under tension in the operating position for driving the agitation member and the belt is relaxed in the replacement position for ease of removal and replacement of the belt.

18 Claims, 6 Drawing Sheets

CLEANING APPLIANCE WITH AGITATION MEMBER MOUNTING BRACKET

BACKGROUND OF THE INVENTION

This invention relates to an agitation member supported in a floor supported housing of a cleaning appliance, and, more particularly to a power foot with a pivotally mounted agitation member bracket.

FIELD OF THE INVENTION

Cleaning appliances such as upright vacuum cleaning machines, canister vacuum cleaning machines, and water extraction machines have long incorporated a cylindrical agitation member rotatively mounted to the floor supported housing to agitate a carpet surface and thereby enhance the cleaning performance of the machine. In an upright vacuum cleaning machine, the agitation member is typically mounted in a lower, floor supported housing. In canister vacuum cleaning machines and water extraction machines, the agitation member is typically mounted in a power foot housing. In each of these machines, the drive shaft and agitation member are usually mounted a fixed distance apart from one another and are interconnected through a belt and pulley wheels. The belt is under tension when the belt is properly mounted to the motor drive shaft pulley wheel and the agitation member pulley wheel. The drive belt must be replaced periodically as a result of wear and tear encountered through ordinary use.

Replacement of a belt typically requires the use of hand tools such as a screwdriver to remove a bottom plate on the floor supported housing. After the plate has been removed, the user often must struggle to stretch the elastic belt to mount it on the drive shaft pulley wheel and the agitation member pulley wheel. This process can be an extremely frustrating and time consuming. Users of these cleaning appliances have long desired to easily and quickly replace worn or broken agitation member drive belts.

U.S. Pat. No. 2,601,698 issued Jul. 1, 1952 to Humphrey and U.S. Pat. No. 2,627,623 issued Feb. 10, 1953 to Humphrey disclose mechanisms for releasing the tension on an agitation member drive belt and for raising the agitation member out of contact with the surface to be cleaned. However, these references do not disclose an efficient and effective way to remove and replace a worn drive belt.

SUMMARY OF THE INVENTION

The invention overcomes the problems of the prior art by mounting the agitation on a bracket which is pivotably mounted to the foot housing to easily release the tension on an agitation motor drive belt and to quickly remove and replace the drive belt without the use of hand tools.

The invention relates to a floor cleaning appliance comprising a housing and a bracket pivotally mounted to the housing for rotation about a first axis of rotation between an operating position and a belt replacement position. The bracket has a pair of opposed sidewalls and a web interconnecting the sidewalls. An agitation member having first and second ends is selectively mounted to the bracket for rotation about a second axis of rotation. A drive motor is mounted in the housing and has a drive shaft which rotates about a third axis of rotation. A belt is selectively mounted to the agitation member and the drive shaft and adapted to convey a force of rotation from the drive shaft to the agitation member. In the operating position for the bracket, the first axis of rotation lies on one side of a plane extending between the second and third axes of rotation. In the operating position, the first axis of rotation lies on another side of the plane extending between the second and third axes of rotation. The belt is under tension in the operating position for driving the agitation member and the belt is relaxed in the replacement position for ease of removal and replacement of the belt.

In one embodiment, the first end of the agitation member is mounted in an aperture formed in one of the bracket sidewalls and the second end of the agitation member is mounted in a slot formed in the other of the bracket sidewalls. Preferably, the slot extends in a direction away from the third axis of rotation.

In another embodiment, the first axis of rotation lies between the second and third axes of rotation when the bracket is received in the operating position.

In still another embodiment, each of the sidewalls have one of a mounting pin and a pin aperture formed therein and the housing has the other of the mounting pin and pin aperture mounted thereto to mount the bracket to the sidewalls of the housing.

In one embodiment, the mounting bracket further comprises a belt flange which extends laterally from the web of the bracket. The belt flange is adapted to shield the belt from the surface being cleaned while the bracket is mounted in the operating position.

In one embodiment, the cleaning appliance comprises a lower housing of an upright vacuum cleaning machine. In a further embodiment, the cleaning appliance comprises a power foot of a canister vacuum cleaning machine. In still another embodiment, the cleaning appliance comprises a power foot of a water extraction cleaning machine.

In another embodiment of the invention, the first axis of rotation is mounted a first spaced distance from the plane extending between the second and third axes of rotation in the operating position. In the belt replacement position, the first axis of rotation is a second spaced distance from the plane extending between the second and third axes of rotation, the second spaced distance being greater than the first spaced distance.

BRIEF DESCRIPTION OF THE DRAWINGS

The invention will now be described with reference to the drawings wherein.

DESCRIPTION OF THE PREFERRED EMBODIMENT

Figure 1:
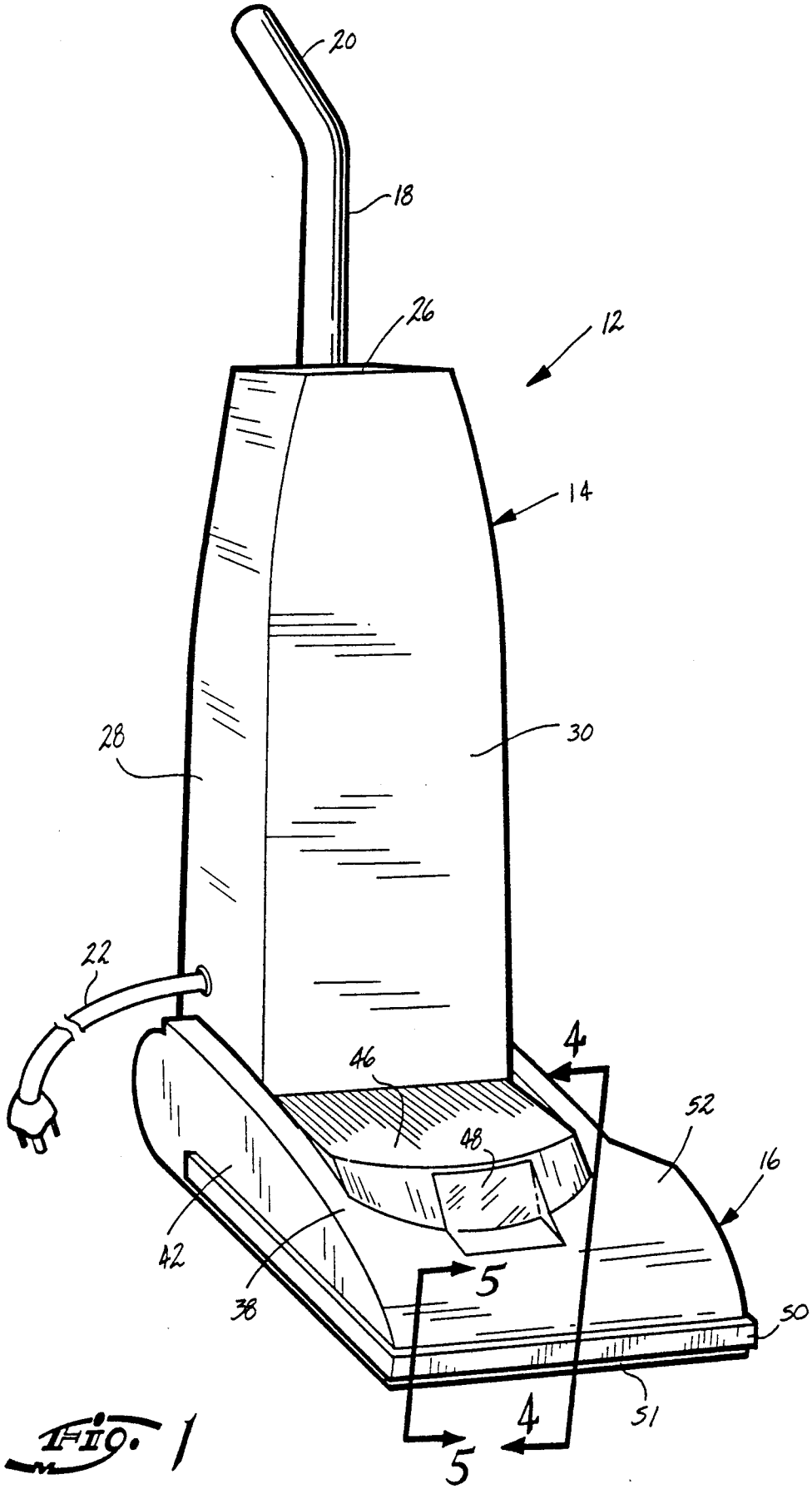
FIG. 1 comprises a perspective view of an upright vacuum cleaning appliance according to the invention.

Referring now to the drawings and to FIG. 1 in particular, an upright vacuum cleaning appliance 12 comprises an upright housing 14 pivotally mounted to a floor engaging lower housing 16. An upwardly extending support member 18 is mounted to the rear of the upper housing 14 and can be pivotably mounted to the lower housing 16. A grip 20 is mounted at the upper terminal end of the support member 18 and is adapted to be grasped by a user when the appliance 12 is in use. An electrical cord 22 interconnects the upper housing 14 to a source of electricity.

The upper housing 14 comprises a top wall 26, a pair of opposing sidewalls 28, a front wall 30 and a rear wall 32. A vacuum motor (not shown) and a vacuum bag (not shown) are mounted within the upper housing 14. The vacuum motor receives electricity from the source of electricity through the cord 22 and is adapted to create a source of suction which is conveyed to the lower housing 16. The vacuum bag is adapted to receive and filter dirt and dust collected by the source of suction.

Figure 2:
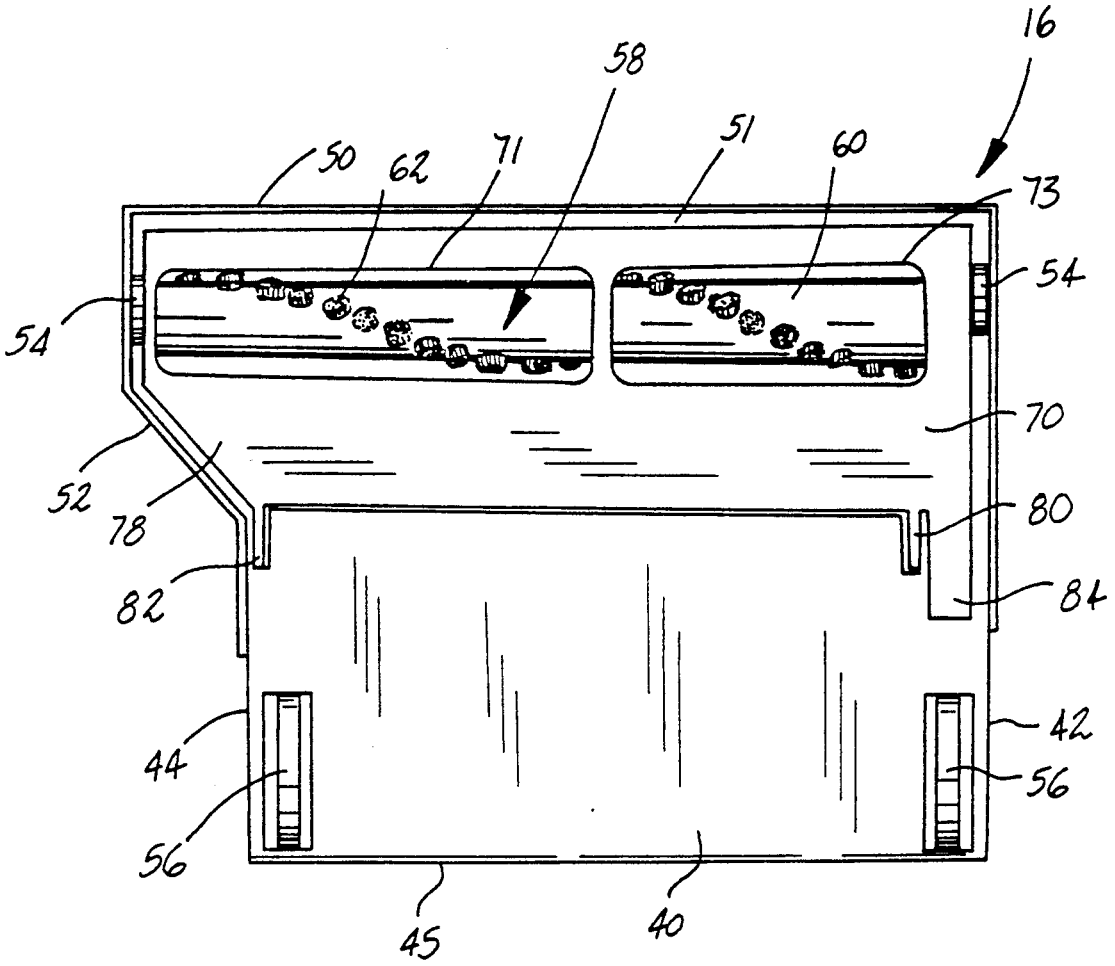
FIG. 2 is a bottom view of the lower housing of the upright vacuum cleaning appliance as seen in FIG. 1;.

As seen in FIGS. 1 and 2, the lower housing 16 comprises a sloping top wall 38, a bottom wall 40 a pair of opposed sidewalls 42, 44 and an arcuate rear wall 45. A projection 46 extends upwardly from the top wall 38 and a light lens 48 is mounted to the front of the projection 46. A light bulb (not shown) is mounted within the lower housing below the light lens 48 to illuminate the area in front of the lower housing 16 of the upright vacuum cleaning machine 12 if desired.

Preferably, an elastic bumper 50 extends along the front edge 51 and sidewalls 42, 44 of the lower housing 16 to protect the housing 16 and adjacent articles of furniture and the like. An edge cleaning projection 52 extends laterally from the sidewall 44. A pair of front wheels 54 (FIG. 2) and rear wheels 56 are rotatably mounted to the lower housing 16 to allow for easy movement of the housing 16 over the surface to be cleaned.

Figure 3:
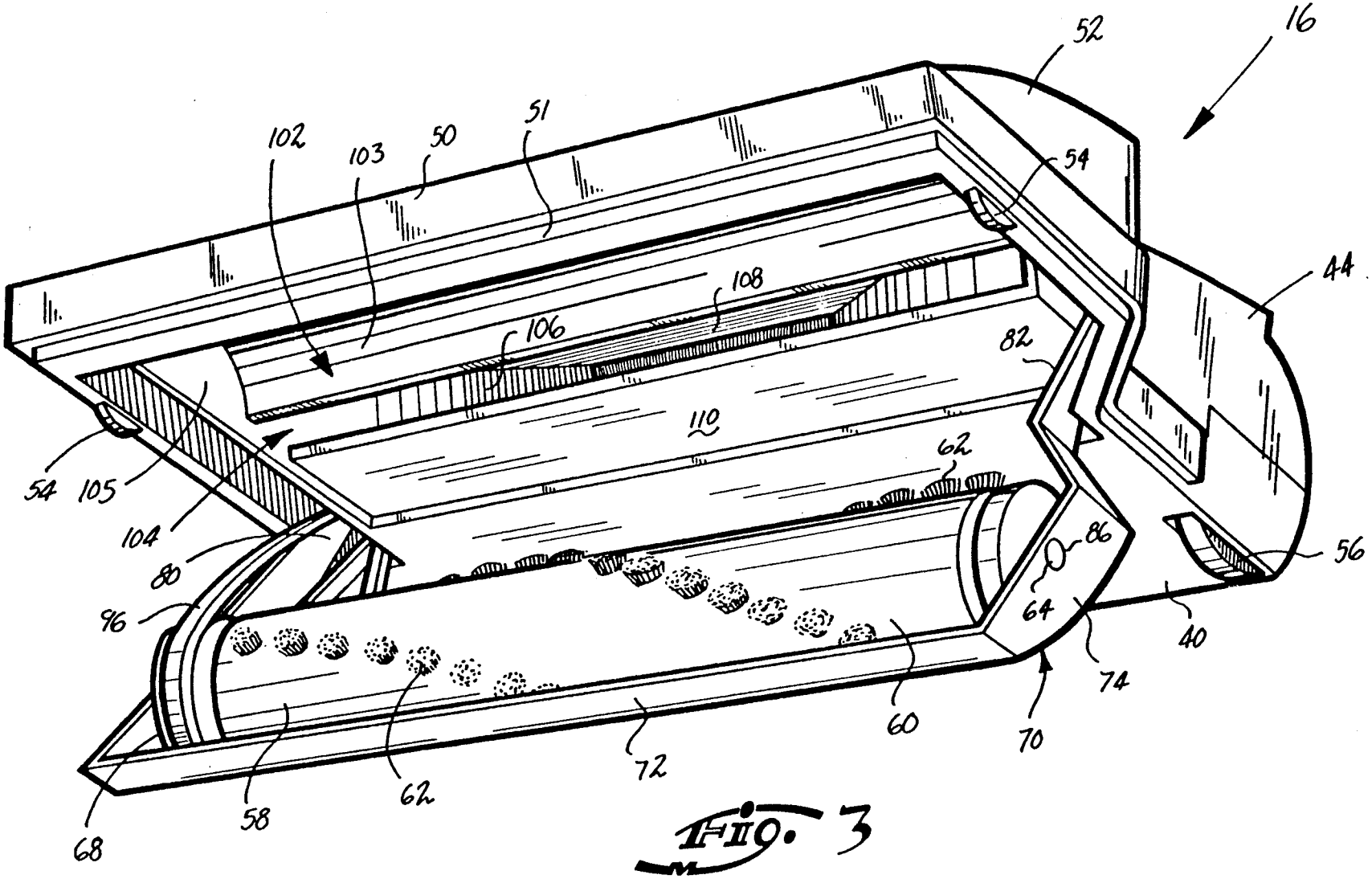
FIG. 3 is a lower, perspective view of the lower housing of the cleaning appliance of FIG. 1 with an agitator mounting bracket pivoted to an open position for replacement of a drive belt.

As seen in FIGS. 2 and 3, an agitation member 58 is selectively received in the lower housing 16. The agitation member 58 comprises a tubular support member 60, a plurality of bristles 62 extending outwardly from the support member 60, a first mounting pin 64 and a second mounting pin 66. One mounting pin is mounted on each end of the support member 65. Conventional bearings (not shown) are mounted inside the ends of the support member 60 to rotatively mount the pins 64, 66 to the support member 60. The pins 64, 66 of the agitation member 58 are selectively mounted in a mounting bracket 70 of the lower housing 16, the bracket 70 being pivotally mounted to the lower housing 16. The mounting bracket 70 can be fixed in the lower housing 16 or can be removable to facilitate belt replacement. The mounting bracket 70 comprises a front wall 72, a pair of opposed sidewalls 74, 76 a bottom wall 78, and a pair of rearwardly extending mounting arms 80, 82. A belt flange 84 is mounted at one corner of the bottom wall 78 and extends rearwardly therefrom.

The first mounting pin 64 of the agitation member 58 is received in a pin mounting aperture 86 on the second sidewall 76 of the mounting bracket 70 and the second mounting pin 66 is selectively received in a pin mounting slot 88 formed on the first sidewall 74 of the mounting bracket 70.

Figure 4:
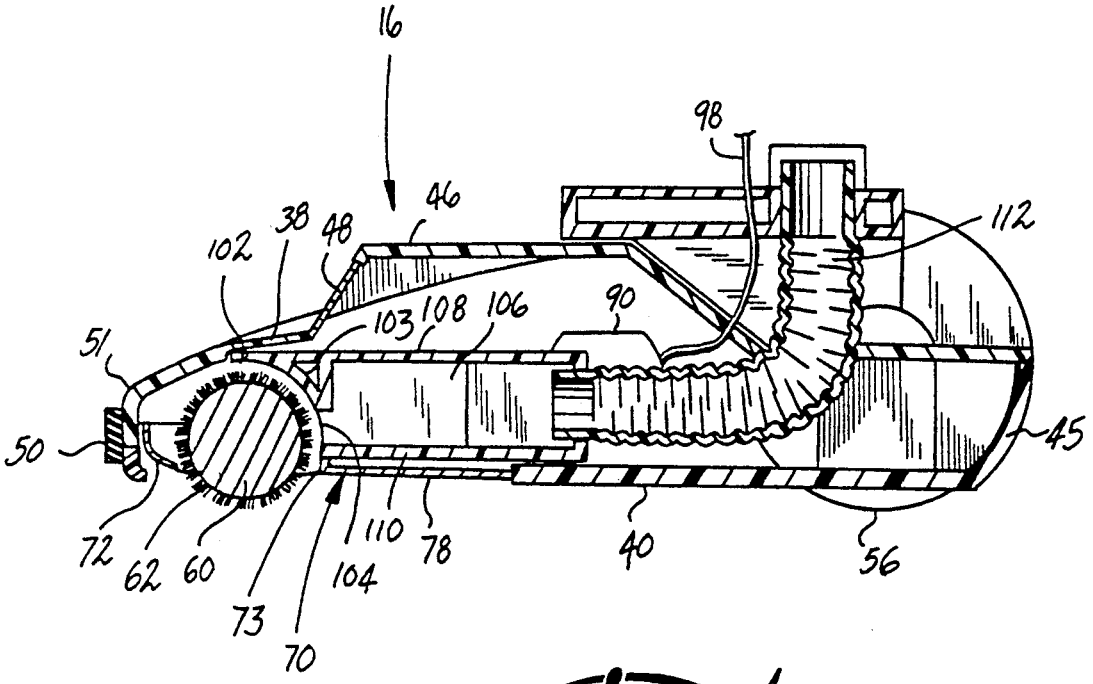
FIG. 4 is a sectional view of the lower housing of an upright vacuum taken along lines 4—4 of FIG. 1.
Figure 5:
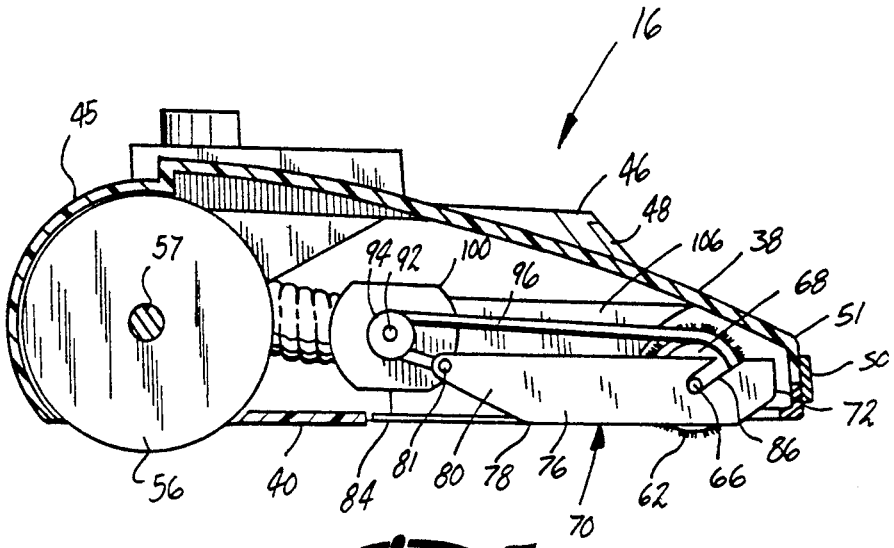
FIG. 5 is a sectional view of the lower housing taken along lines 5-5 of FIG. 1 with the agitator mounting bracket received in the operating position.

As seen in FIGS. 4 and 5, the pin mounting slot 88 extends upwardly and forward relative to the lower housing 16 when the mounting bracket 70 is in the operating position. An agitation member motor 90 is mounted in the lower housing 16 on the opposite side of the lower housing from the edge cleaning projection 52. A drive shaft 92 extends outwardly from the motor 90 and has a pulley 94 mounted thereto. A drive belt 96 is selectively received on the drive shaft pulley 94.

As seen in FIGS. 2 and 3, the lower housing further comprises an arcuate-shaped agitation member recess 102 formed adjacent the front edge 51 of the lower housing 16. The recess 102 has an arcuate shaped top wall 103, two opposed sidewalls 105 and receives the agitation member 58 when the member 58 is in the operating position. A suction nozzle 104 is mounted in the lower housing, the nozzle comprising a sidewall 106, a top wall 108, and a bottom wall 110. The nozzle 104 extends from the agitation member recess 102 to a flexible conduit 112. The nozzle 104 is funnel shaped, the wide end being adjacent the recess 102 and the narrow end being mounted to the flexible conduit 112. The flexible conduit extends from the suction nozzle 104 in the lower housing 16 to an impeller and the vacuum bag (not shown) in the upper housing 14.

In use as an upright vacuum, the vacuum motor mounted within the upper housing 14 creates a source of suction which is conveyed to the floor engaging lower housing 16. The source of suction is applied to the surface to be cleaned through the bristle openings 71, 73 formed on the bottom of the mounting bracket 70. The suction collects dirt and dust and conveys it from the bristle openings 71, 73 to the agitation member recess 102, to the suction nozzle 104, to the flexible conduit 112 and ultimately to the vacuum bag (not shown). As the source of suction is applied, the agitation member motor 90 rotates the belt 96 and agitation member 58. The bristles 62 of the agitation member 58 extend downwardly through the bristle openings 71, 73 to penetrate and agitate the carpet surface to be cleaned. The rotating agitation member 58 enhances the cleaning performance of the vacuum cleaning machine.

As seen in FIGS. 1-3, the edge cleaning projection 52 is formed on one of the sidewalls 44 of the lower housing. The side edge of the first bristle opening 71 extends to a point immediately adjacent to the sidewall 44 of the housing. Therefore, the user can effectively clean carpeting or other surfaces to be vacuumed along the edge of the carpeting immediately adjacent to a wall or articles of furniture.

Conventional vacuum cleaner belts interconnecting the drive shaft and agitation member are typically formed of an elastomeric rubber material which will stretch slightly when subjected to a sufficiently large amount of force. The mounting brackets 70 are pivotally mounted to the underside of the lower housing 16 such that the belt will be under tension in the operating position and the belt will be relaxed and easily removed from the agitation member 58 and drive shaft 92 in the belt replacement position.

Figure 6:
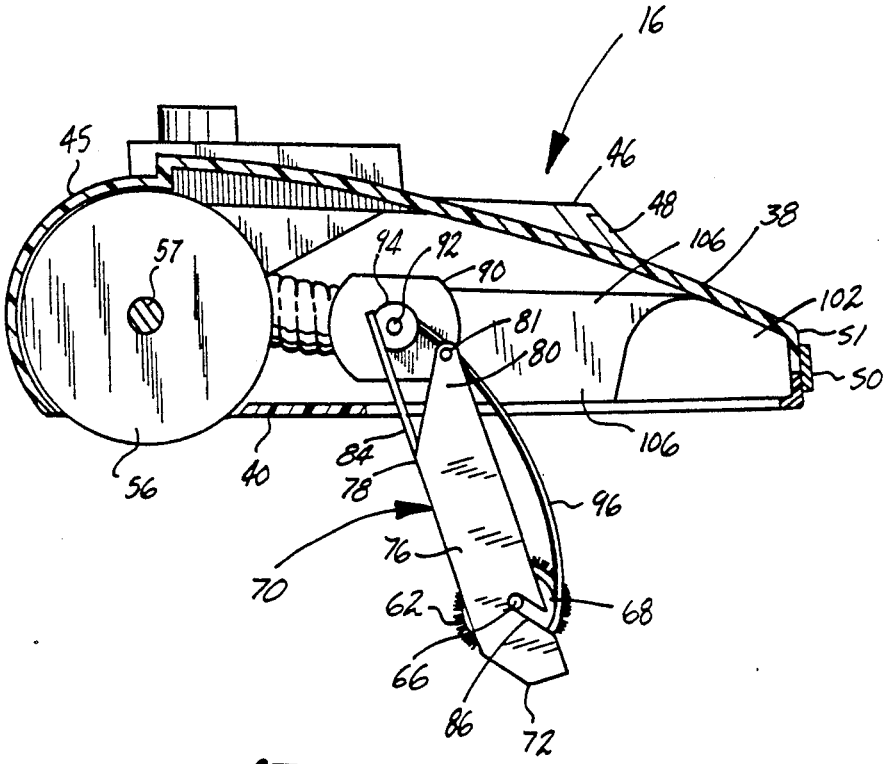
FIG. 6 is a sectional view of the lower housing as seen in FIG. 5 with the agitator mounting bracket pivoted to the open or belt replacement position.

As seen in FIGS. 3, 5, and 6, the mounting pins 81 extend inwardly from the sidewalls 42, 44 of the lower housing. The mounting pins 81 are received in apertures formed in the opposed mounting arms 80, 82 of the mounting bracket 70. Therefore, the bracket 70 is pivotally mounted to the lower housing about an axis extending between the mounting pins 81. In the operating position, as seen in FIG. 5, the mounting pin 81 lies intermediate the axis of rotation of the drive shaft 92 and the axis of rotation of the agitation member 58 and slightly below a plane extending between these two axes.

When the user desires to replace a worn belt 96, access the interior of the lower housing, or service the agitation member 58, then the user grasps the mounting bracket 70 and pulls it downward relative to the lower housing 16. Due to the tension in the belt 96, the user encounters increasing resistance to rotation of the bracket 70 from the operating position as seen in FIG. 5 until the point is reached wherein the axes of rotation of the drive shaft 92, mounting pin 81 and agitation member 58 all lie in a single plane. At this point, the elastic belt 96 will be under maximum tension. As the user continues to rotate the mounting bracket 70 past this common plane, then the amount of tension on the belt 96 will be reduced because the distance between the axes of rotation of the agitation member 58 and drive shaft 92 decrease. Ultimately, the bracket 70 is pivoted to the belt replacement position, as seen in FIG. 6, where there is no tension in the belt 96. In this position, the bracket 70 is approximately normal to the bottom wall 40 of the housing 16. In this position, the agitation member 58 can be easily removed from the mounting bracket 70 by sliding the second mounting pin 66 of the agitation member 58 through the forwardly extending slot 88. Once the pin 66 is removed from the slot 88, then the agitation member 58 can be removed laterally to remove the first mounting pin 64 (FIG. 3) from the pin mounting aperture 86 (FIG. 3) formed on the opposite side of the mounting bracket 70 from the slot 88. Then, the user can perform any cleaning or service necessary for the agitation member 58 or replace a worn belt 96.

The belt 96 is installed by inserting the first mounting pin 64 (FIG. 3) in the pin mounting aperture 86 (FIG. 3). Then, the belt 96 is looped around the drive shaft pulley 94. Next, the relaxed belt 96 is easily and effortlessly mounted on the agitation member pulley 68 and then the second mounting pin 66 is inserted in the pin mounting slot 88. Finally, the user pivots the mounting bracket 70 about its axis of rotation from the belt replacement position as seen in FIG. 6 to the operating position as seen in FIG. 5.

As the bracket 70 pivots upwardly, the tension on the belt 96 will gradually increase until the point is reached wherein the axes of rotation for the drive shaft 92, the mounting bracket 70, and the agitation member 58 all lie along a common plane. At this point, the belt 96 is once again under maximum tension. As rotation of the mounting bracket 70 continues about its axis of rotation, the bracket 70 will snap into the operating position as seen in FIG. 5. The tension on the belt 96, decreases slightly from the point of maximum tension when the three axes of rotation are aligned to the operating position as seen in FIG. 5. Therefore, the elasticity of the belt 96 will bias the mounting bracket 70 into the operating position and maintain the bracket 70 in this position.

A significant element of the preferred embodiment of the invention is the over-center position of the axis of rotation of the mounting bracket 70 relative to the axes of rotation of the drive shaft 92 and agitation member 58. In the operating position, the axis of rotation of the mounting bracket 70 lies on one side of the plane extending between the axes of rotation of the drive shaft 92 and the agitation member 58. In the belt replacement position, the axis of rotation of the mounting bracket 70 lies on the other side of the plane extending between the axes of rotation of the drive shaft 92 and agitation member 58. While the over-center mounting position is desirable in the preferred embodiment, it is by no means necessary to create a floor engaging housing for a cleaning appliance which permits selective tensioning and relaxation of the drive belt. For example, the axis of rotation of the mounting bracket 70 could be mounted such that it always lies on the same side of the plane extending between the axes of rotation of the drive shaft 92 and agitation member 58 in both the operating and the belt replacement position. The bracket 70 can be adapted to pivot from a relaxed position as seen in FIG. 6 to an operating position where the belt 96 is under tension and the mounting bracket 70 is held in position by a latch or other mechanical means. In this embodiment, the axis of rotation of the mounting bracket would be parallel to and significantly closer to the plane extending between the axes of rotation of the agitation member and drive shaft in the operating position, than in the belt replacement position. While this embodiment does not have the advantage of utilizing the elasticity of the belt 96 to hold the mounting bracket 70 in the operating position, it achieves the overall advantage of selectively tensioning the belt through the pivoting action of the agitation member and mounting bracket relative to the lower housing 16.

Figure 7:
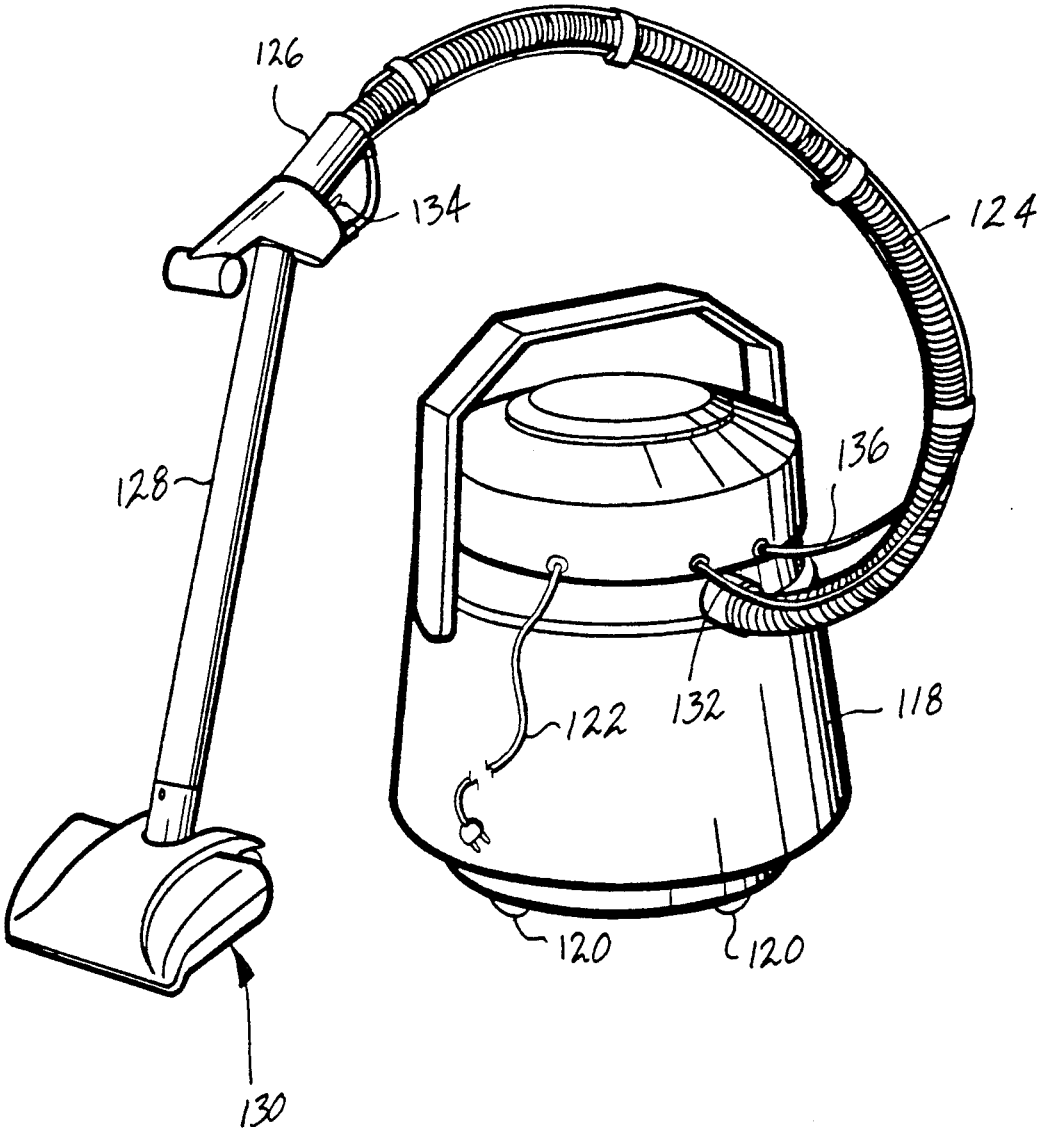
FIG. 7 is a perspective view of a combination canister type dry vacuum machine and liquid extraction machine incorporating an agitator mounting bracket according to the invention.

The pivotal mounting bracket 70 according to the invention can also be easily incorporated into a power foot for a canister vacuum cleaning machine, a water extraction cleaning machine or a combination canister vacuum cleaning/water extraction machine. A combination canister vacuum cleaning/water extraction machine 116 is seen in FIG. 7. The machine comprises a machine housing 118 which is supported by a plurality of casters 120. The machine housing 118 is interconnected to a source of electricity through an electrical cord 122. A vacuum motor (not shown) and vacuum bag or other dirt receptacle (not shown) is mounted inside the machine housing 118. In addition, a solution reservoir (not shown) and pump motor are mounted on the interior of the housing. A flexible hose 124 extends from the machine housing 118 to a grip tube 126. A rigid wand 128 extends from the grip tube 126 to the power foot housing 130. A solution tube 132 extends from the machine housing 118 along the flexible hose 124 and wand 128 to the power foot housing 130. A trigger 134 mounted to the grip tube 126 controls the flow of solution from the pump motor within the machine housing 118 to the power foot housing 130 through the solution tube 132. Conventional spray nozzles (not shown) are mounted to the bottom side of the power foot housing 130 for distributing the cleaning solution to the surface to be cleaned. An electrical cord 136 extends from the machine housing 118 along the flexible hose 124 and the wand 128 to the power foot housing 130. The electrical cord is electrically connected to the drive motor mounted in the power foot housing 130.

The mounting bracket 70 described above can be easily mounted to the power foot housing 130 for the combination vacuum cleaning/water extraction machine 116. As in the first embodiment, the mounting bracket 70 would be mounted to inwardly extending pins from the sidewalls of the power foot housing 130.

As in the first embodiment, the mounting bracket 70 would be adapted to be received in an operating position where the belt is under tension and a belt replacement position where the belt is relaxed.

While particular embodiments of the invention have been described above, it will be understood, of course, that the invention is not limited thereto since modifications may be made by those skilled in the art, particularly in light of the foregoing teachings. Reasonable variation and modification are possible within the foregoing disclosure of the invention without departing from the scope of the invention.

The embodiments for which an exclusive property or privilege is claimed are defined as follows:

1. A floor cleaning appliance comprising;
a housing;
a bracket having a pair of opposed sidewalls and a web interconnecting the sidewalls, the bracket being pivotally mounted to said housing for rotation about a first axis of rotation between an operating position and a belt replacement position;
an agitation member selectively mounted to the bracket for rotation about a second axis of rotation, the agitation member having first and second ends;
a drive motor mounted in the housing, the motor having a drive shaft which rotates about a third axis of rotation;
a belt selectively mounted to the agitation member and the drive shaft and adapted to convey a force of rotation from the drive shaft to the agitation member, the first axis of rotation lying on one side of a plane extending between the second and third axes of rotation in the operating position and the first axis of rotation lying on another side of the plane extending between the second and third axes of rotation in the belt replacement position.
whereby, the belt is under tension in the operating position for driving of the agitation member and the belt is relaxed in the replacement position for ease of removal and replacement of the belt.

2. A floor cleaning appliance according to claim 1 wherein the first end of the agitation member is mounted in an aperture formed in one of the bracket sidewalls and the second end is mounted in a slot formed in the other of the bracket sidewalls.

3. A floor cleaning appliance according to claim 2 wherein the slot extends in a direction away from the third axis of rotation.

4. A floor cleaning appliance according to claim 1 wherein the first axis of rotation lies between the second and third axes of rotation when said bracket is in said operating position.

5. A floor cleaning appliance according to claim 1 wherein each of the sidewalls have one of a mounting pin and a pin aperture formed therein and the housing has the other of the mounting pin and pin aperture mounted thereto to mount the bracket sidewalls to the housing.

6. A floor cleaning appliance according to claim 1 wherein said bracket further comprises a belt flange extending laterally from the web of the bracket, the belt flange being adapted to shield the belt from the surface being cleaned while the bracket is mounted in the operating position.

7. A floor cleaning appliance according to claim 1 wherein said housing comprises a lower housing of an upright vacuum cleaning machine.

8. A floor cleaning appliance according to claim 1 wherein said housing comprises a power foot of a canister vacuum cleaning machine.

9. A floor cleaning appliance according to claim 1 wherein said floor engaging housing comprises a power foot of a water extraction cleaning machine.

10. A floor cleaning appliance comprising;
a housing;
a bracket having a pair of opposed sidewalls and a web interconnecting the sidewalls, the bracket being pivotally mounted to said housing for rotation about a first axis of rotation between an operating position and a belt replacement position;
an agitation member selectively mounted to the bracket for rotation about a second axis of rotation, the agitation member having first and second ends;
a drive motor mounted in the housing, the motor having a drive shaft which rotates about a third axis of rotation;
a belt selectively mounted to the agitation member and the drive shaft and adapted to convey a force of rotation from the drive shaft to the agitation member, the first axis of rotation being a first spaced distance from a plane extending between the second and third axes of rotation in the operating position and the first axis of rotation being a second spaced distance from the plane extending between the second and third axes of rotation in the belt replacement position, the second spaced distance being greater than the first spaced distance;
whereby, the belt is under tension in the operating position for driving the agitation member and the belt is relaxed in the replacement position for removal and replacement of the belt.

11. A floor cleaning appliance according to claim 10 wherein the first end of the agitation member is mounted in an aperture formed in one of the bracket sidewalls and the second end is mounted in a slot formed in the other of the bracket sidewalls.

12. A floor cleaning appliance according to claim 11 wherein the slot extends in a direction away from the third axis of rotation of the drive motor relative to the second axis of rotation when the agitation member is mounted in the operating position.

13. A floor cleaning appliance according to claim 10 wherein said first axis of rotation is between said second and third axes of rotation when said bracket is in the operating position.

14. A floor cleaning appliance according to claim 10 wherein each of said sidewalls have one of a mounting pin and a pin aperture formed therein and the housing has the other of the mounting pin and pin aperture mounted thereto to mount the bracket sidewalls to the housing.

15. A floor cleaning appliance according to claim 10 wherein said bracket further comprises a belt flange extending laterally from the web of the bracket, the belt flange being adapted to shield the belt from the surface being cleaned while the bracket is mounted in the operating position.

16. A floor cleaning appliance according to claim 10 wherein said housing comprises a lower housing of an upright vacuum cleaning machine.

17. A floor cleaning appliance according to claim 10 wherein said housing comprises a power foot of a canister vacuum cleaning machine.

18. A floor cleaning appliance according to claim 10 wherein said housing comprises a power foot of a water extraction cleaning machine.

* * * * *